US012607086B2

(12) United States Patent
Urrutia

(10) Patent No.: US 12,607,086 B2
(45) Date of Patent: Apr. 21, 2026

(54) BLOWOUT PREVENTER SYSTEM AND METHOD UTILIZING SHEAR RAM BUTTRESS

(71) Applicant: Schlumberger Technology Corporation, Sugar Land, TX (US)

(72) Inventor: Miguel Urrutia, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/075,314

(22) Filed: Mar. 10, 2025

(65) Prior Publication Data

US 2025/0243726 A1 Jul. 31, 2025

Related U.S. Application Data

(63) Continuation of application No. 18/455,153, filed on Aug. 24, 2023, now Pat. No. 12,247,456.

(51) Int. Cl.
*E21B 33/06* (2006.01)

(52) U.S. Cl.
CPC ..... *E21B 33/063* (2013.01)

(58) Field of Classification Search
CPC ..... E21B 33/063; E21B 33/062
See application file for complete search history.

(56) References Cited

U.S. PATENT DOCUMENTS 4,132,265 A * 1/1979 Williams, Jr. ..... E21B 29/08 251/1.3
4,132,266 A * 1/1979 Randall ..... E21B 33/063 251/1.3
4,132,267 A * 1/1979 Jones ..... E21B 33/063 251/1.3
4,540,046 A * 9/1985 Granger ..... E21B 33/063 166/55
8,720,564 B2 * 5/2014 Springett ..... E21B 33/063 166/85.4

* cited by examiner

*Primary Examiner* — Giovanna Wright
(74) *Attorney, Agent, or Firm* — Kelly C. Brewerton

(57) ABSTRACT

A technique facilitates reliable operation of a blowout preventer (BOP) system. The reliable operation is achieved by utilizing a ram with improved strength so as to make it better able to resist the stresses from shearing without increasing the thickness of the ram blade. As a result, a high level of efficiency is maintained during a shearing action. According to an embodiment, a blowout preventer system comprises a blowout preventer shear ram assembly having a ram for shearing a tubular member. The ram comprises a main body and a blade extending from the main body. Additionally, a ramp buttress is secured to the blade to strengthen the blade and to improve the shearing action.

10 Claims, 5 Drawing Sheets

BLOWOUT PREVENTER SYSTEM AND METHOD UTILIZING SHEAR RAM BUTTRESS

CROSS-REFERENCE TO RELATED APPLICATION

This application is a continuation of U.S. application Ser. No. 18/455,153, filed on Aug. 24, 2023, the entirety of which is incorporated herein by reference.

BACKGROUND

In many oil and gas well applications, various types of equipment may be used to contain and isolate pressure in the wellbore. For example, a blowout preventer system may be installed on a wellhead to protect against blowouts. The blowout preventer has a longitudinal interior passage which allows passage of pipe, e.g. drill pipe, and other well components. Additionally, the blowout preventer has a variety of features including rams, e.g. shear rams and pipe rams, which facilitate rapid well sealing operations. Control over operation of the blowout preventer generally is achieved with various types of hydraulic controls although other methods of control may be used.

When the blowout preventer shear rams are actuated to cut drill pipe they experience high forces and stress loads which can damage the rams and the seals associated with the rams. The potential for damage can be reduced by making the ram larger or thicker to provide greater strength. However, this approach causes the shearing action of the rams to be less efficient while requiring higher actuation pressures and placing limits on the upper size of the pipe that can be sheared.

SUMMARY

In general, a system and method facilitate reliable operation of a blowout preventer (BOP) system. The reliable operation is achieved by utilizing a ram with improved strength, thus making it better able to resist the stresses from shearing without increasing the thickness of the ram blade. As a result, a high level of efficiency is maintained during a shearing action. According to an embodiment, a blowout preventer system comprises a blowout preventer shear ram assembly having a ram for shearing a tubular member. The ram comprises a main body and a blade extending from the main body. Additionally, a ramp buttress is secured to the blade to strengthen the blade. The ramp buttress comprises a ramp constructed to increase in thickness from a thinner end to a thicker end in a direction moving away from a shearing edge of the blade toward the main body. By utilizing this ramp buttress, the ram is strengthened without adding substantial thickness to the ram blade while also providing a ramp that lifts the cut tubular member up out of the way of the shearing region.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and method which facilitate reliable operation of a blowout preventer (BOP) system. The reliable operation is achieved by utilizing a ram with improved strength making it better able to resist the stresses from shearing without increasing the thickness of the ram blade. As a result, a high level of efficiency is maintained during a shearing action. According to an embodiment, a blowout preventer system comprises a blowout preventer shear ram assembly having a ram for shearing a tubular member. The ram comprises a main body and a blade extending from the main body. Additionally, a ramp buttress is secured to the blade to strengthen the blade and to improve the shearing action.

The ramp buttress comprises a ramp constructed to increase in thickness from a thinner end to a thicker end in a direction moving away from a shearing edge of the blade toward the main body. By utilizing this ramp buttress, the ram is strengthened without adding substantial thickness to the ram blade while also providing a ramp that lifts the cut tubular member up out of the way of the shearing region. Effectively, the ramp buttress enables construction of a thin blade for easier, efficient shearing of a tubular member while providing substantially greater strength against damage during the shearing operation.

Additionally, the ramp facilitates shearing by lifting the cut tubular member up and out of the way of the blade and the blade seal if present. For example, an elastomer seal may be used along the blade and the ramp serves to lift at least the back side of the tubular member away from the elastomer seal during the shearing operation. Simultaneously, this lifting of the tubular member moves it away from the shear region of the ram so as to reduce the force otherwise required to cause closure of the ram. Without this lift, the ram would be forced to deform and crush the cut tubular member so as to make room for full closure during the shearing operation.

Figure 1:
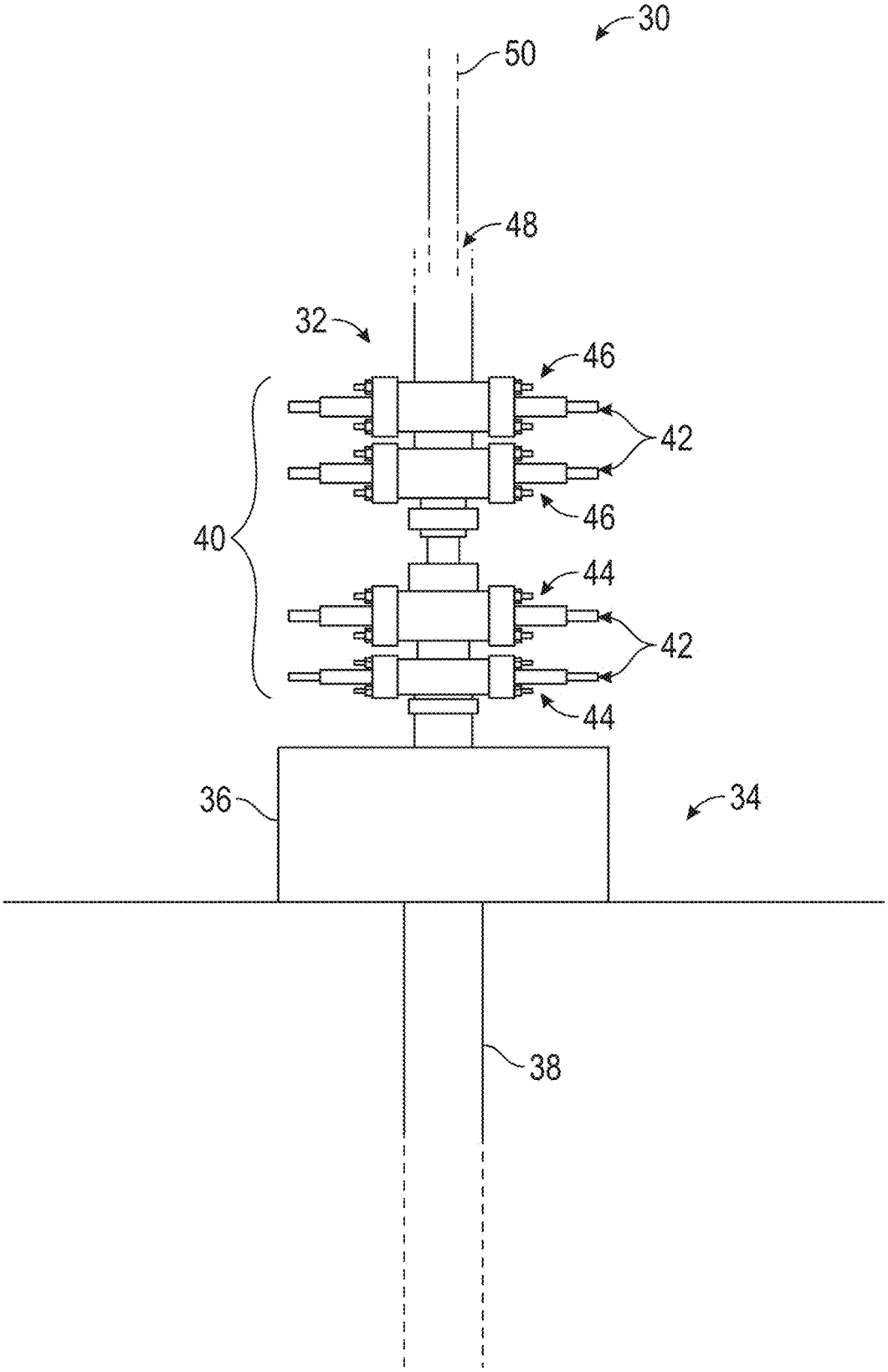
FIG. 1 is an illustration of an example of an overall well blowout preventer (BOP) system mounted on a wellhead above a borehole, according to an embodiment of the disclosure.

Referring generally to FIG. 1, a well system 30 is illustrated as comprising a BOP system 32 for providing pressure control at a well 34. In this example, the BOP system 32 is mounted on a wellhead 36, e.g. a land-based wellhead or a subsea wellhead, located above a borehole 38, e.g. a wellbore. The BOP system 32 may be arranged as a BOP stack 40 and may comprise a variety of BOP components, such as ram BOPs 42. By way of example, the ram BOPs 42 may comprise BOP pipe ram assemblies 44 and BOP shear ram assemblies 46. The BOP system 32 may have a central, longitudinal passage 48 for receiving tubular members 50, e.g. drill pipe or other pipe, therethrough.

Figure 2:
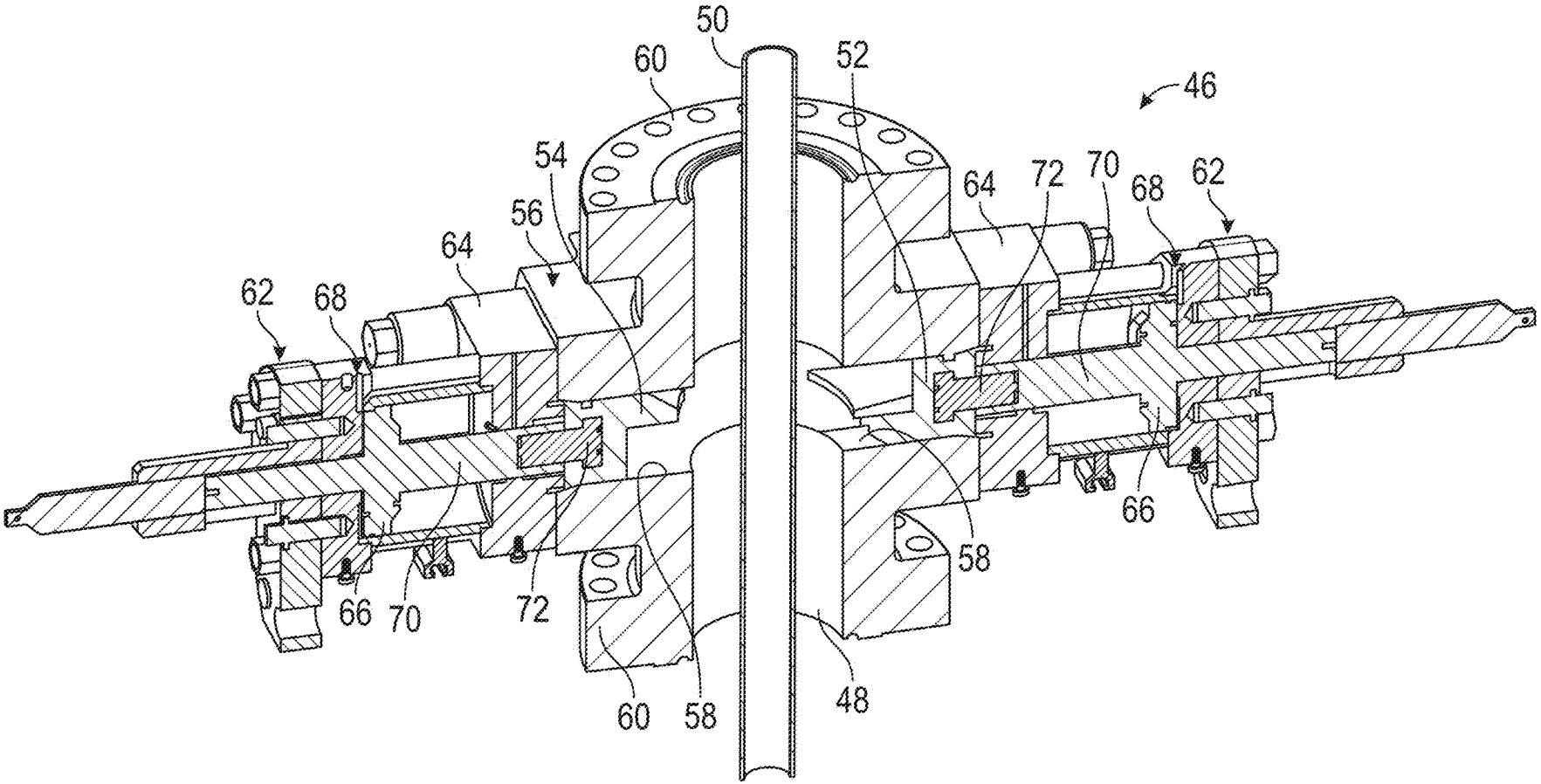
FIG. 2 is a cross-sectional illustration of an example of a BOP shear ram assembly which may be used in the overall BOP system, according to an embodiment of the disclosure.

Referring generally to FIG. 2, one example of a BOP shear ram assembly 46 is illustrated. In this embodiment, the BOP shear ram assembly 46 comprises a shear ram 52 and a corresponding shear ram 54. The corresponding ram 54 is positioned in an opposed relationship relative to ram 52 across longitudinal passage 48 prior to a shearing operation. This enables unobstructed passage of tubular member(s) 50 during a drilling operation or other well related operation.

The ram 52 and corresponding ram 54 may be actuated hydraulically, electromechanically, or via another suitable mode of actuation. During actuation, the ram 52 and corresponding ram 54 are driven towards each other so as to enable shearing of tubular member 50, e.g. a drill pipe, production pipe, casing, or other type of tubular member.

According to the illustrated embodiment, the BOP shear ram assembly 46 comprises a main assembly body 56 through which longitudinal passage 48 extends to allow passage of, for example, fluids and tubular members 50 through the BOP system 32. The ram 52 and corresponding ram 54 are slidably mounted in corresponding passages 58 formed in main assembly body 56. The passages 58 may be generally perpendicular to longitudinal passage 48. As illustrated, the main assembly body 56 also may comprise upper and lower mounting features 60 appropriately configured for coupling with other components of BOP system 32 and/or overall well system 30.

Referring again to FIG. 2, the BOP shear ram assembly 46 also may comprise actuation assemblies 62 for actuating the ram 52 and corresponding ram 54 during a shearing operation. By way of example, each actuation assembly 62 may be connected to the main assembly body 56 by a mounting structure 64.

Furthermore, each actuation assembly 62 may comprise a piston 66 slidably mounted within a corresponding cylinder 68. Each piston 66 may be coupled to the ram 52 or the corresponding ram 54 via a ram shaft 70 and a cooperating coupling mechanism 72, e.g. threaded fastener, headed pin, or other suitable fastening feature.

During a shearing operation, a force directed to each piston 66 causes the piston 66, ram shaft 70, coupling mechanism 72, and corresponding ram 52 or corresponding ram 54 to move in a radially inward direction toward tubular member 50. By way of example, the force directed to each piston 66 may be caused by hydraulic pressure as hydraulic fluid is introduced into cylinders 68 so as to drive the pistons 66 in the radially inward direction as with conventional BOP shear ram assemblies. However, other force application techniques may be employed. Continued application of this force causes the ram 52 and corresponding ram 54 to engage and shear the tubular member 50 in a manner described in greater detail below.

Figure 3:
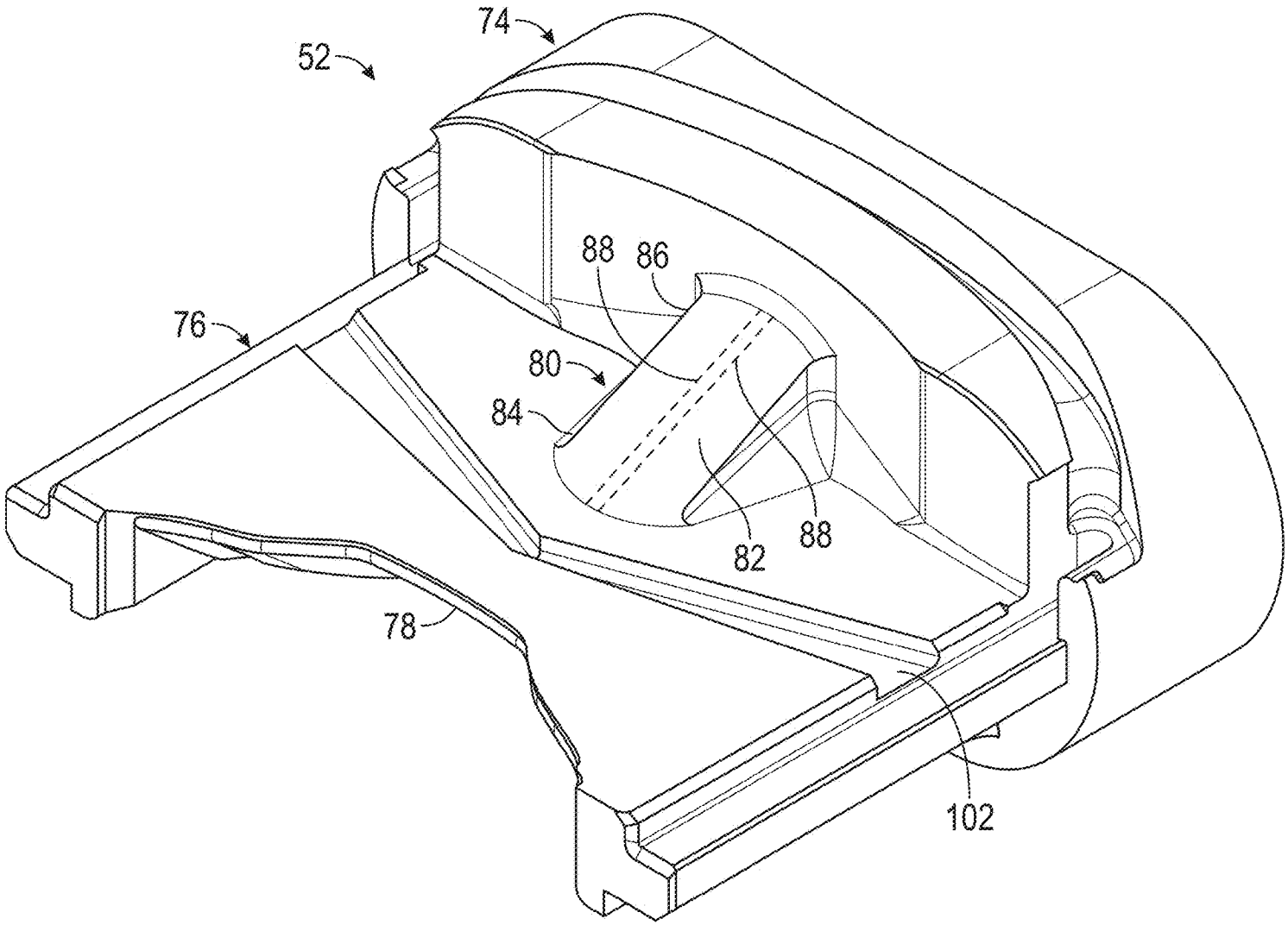
FIG. 3 is an orthogonal illustration of an example of a shear ram which may be used in the BOP shear ram assembly, according to an embodiment of the disclosure.

Referring generally to FIG. 3, an example of ram 52 is illustrated. In this embodiment, ram 52 comprises a main body 74 which may be constructed for coupling to a corresponding actuator. In the illustrated example, main body 74 is constructed for coupling with ram shaft 70 via coupling mechanism 72, however various other types of coupling techniques and coupling mechanisms may be employed. As illustrated, ram 52 further comprises a blade 76 extending from the main body 74. The blade 76 includes a shearing edge 78 disposed generally at an opposite end of blade 76 relative to the main body 74.

The ram 52 also comprises a ramp buttress 80 secured to blade 76. In some embodiments, the ramp buttress 80 may be secured to both blade 76 and main body 74. By way of example, the main body 74, blade 76, and ramp buttress 80 may be integrally formed from the same material, e.g. integrally forged from a suitable metal. However, the formation technique, configuration, and material(s) employed for main body 74, blade 76, and ramp buttress 80 may vary according to parameters of specific well related operations. Regardless, the ramp buttress 80 substantially strengthens the ram 52 without adding substantial thickness to the ram blade 76. Effectively, the ramp buttress 80 enables construction of a thin blade 76 for easier, efficient shearing of tubular member 50 while providing substantially greater strength against damage during the shearing operation.

Figure 4:
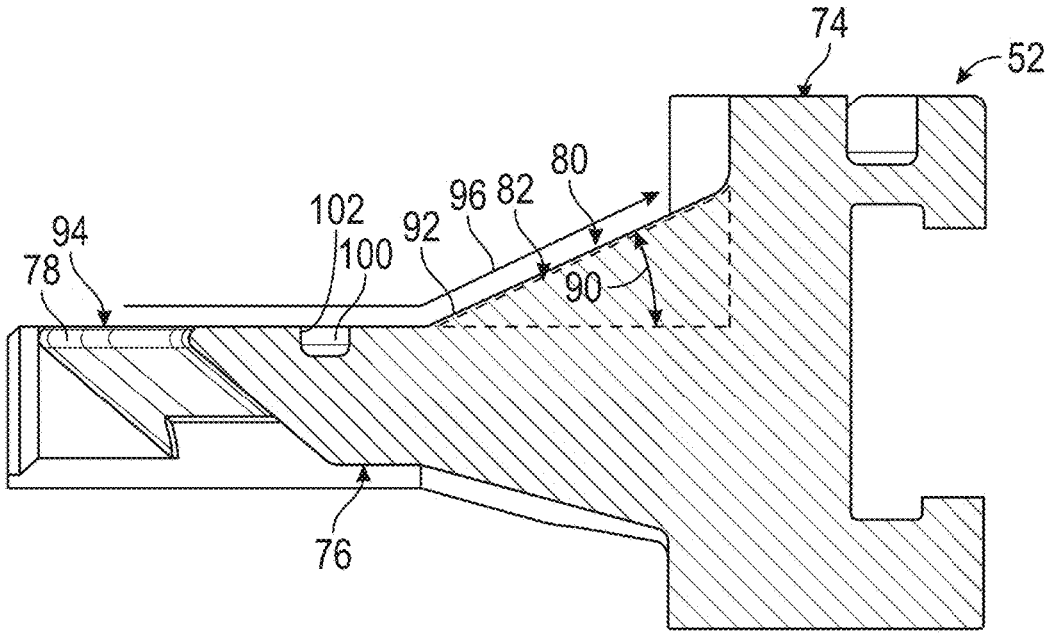
FIG. 4 is a cross-sectional illustration of the shear ram illustrated in FIG. 3, according to an embodiment of the disclosure.

As further illustrated in FIG. 4, the ramp buttress 80 comprises a ramp 82 established by the ramp buttress 80 increasing in thickness from a thinner end 84 to a thicker end 86 in a direction moving away from the shearing edge 78 and toward the main body 74. As represented by the dashed lines 88 in FIG. 3, the ramp buttress 80 may be formed with a single ramp 82 or a plurality of ramps 82. Additionally, the width across the face of the single ramp 82 (or the plurality of ramps 82) may be adjusted depending on the amount of strengthening needed or desired. Additionally, the width may change along the ramp 82. For example, the width of ramp 82 may increase along the ramp as it moves toward the main body 74.

The ramp buttress 80 strengthens the ram 52 by providing support to ram blade 76 against deflection, buckling, and/or other types of damage. The general incline of ramp(s) 82 from thinner end 84 to thicker end 86 relative to ram blade 76 may have various angles depending on the material and size of tubular member 50, environmental conditions, and/or other operational parameters. For example, the incline of ramp(s) 82 may be at a selected angle 90 (illustrated in FIG. 4) in the range from 5° to 45°. In many types of land-based and subsea applications, a suitable angle 90 for a desired or optimal shearing operation is in range from 5° to 30° and in some specific embodiments from 15° to 23°.

In the specific embodiment illustrated in FIG. 4, the single ramp 82 of ramp buttress 80 is formed as a generally flat surface 92 with angle 90 in the range from 15° to 23°. In other words, the ramp 82 is generally linear along flat surface 92. However, the ramp or ramps 82 may be constructed in a variety of non-linear configurations. For example, each ramp 82 may be constructed as convex, concave, with a plurality of angles, with a plurality of small steps, or with various other configurations. Additionally, the lateral or side-to-side shape of each ramp 82 may similarly vary and be convex, concave, changing in width, constructed with a plurality of angles or small steps, or constructed according to various other configurations.

Regardless of the specific structural details of ramp buttress 80, the ramp 82 serves to lift an upper portion of tubular member 50 up and away from a shearing region 94 as indicated by arrow 96 in FIG. 4. The lower portion of tubular member 50, formed from the shearing operation, may be allowed to simply drop downwardly along longitudinal passage 48.

Figure 5:
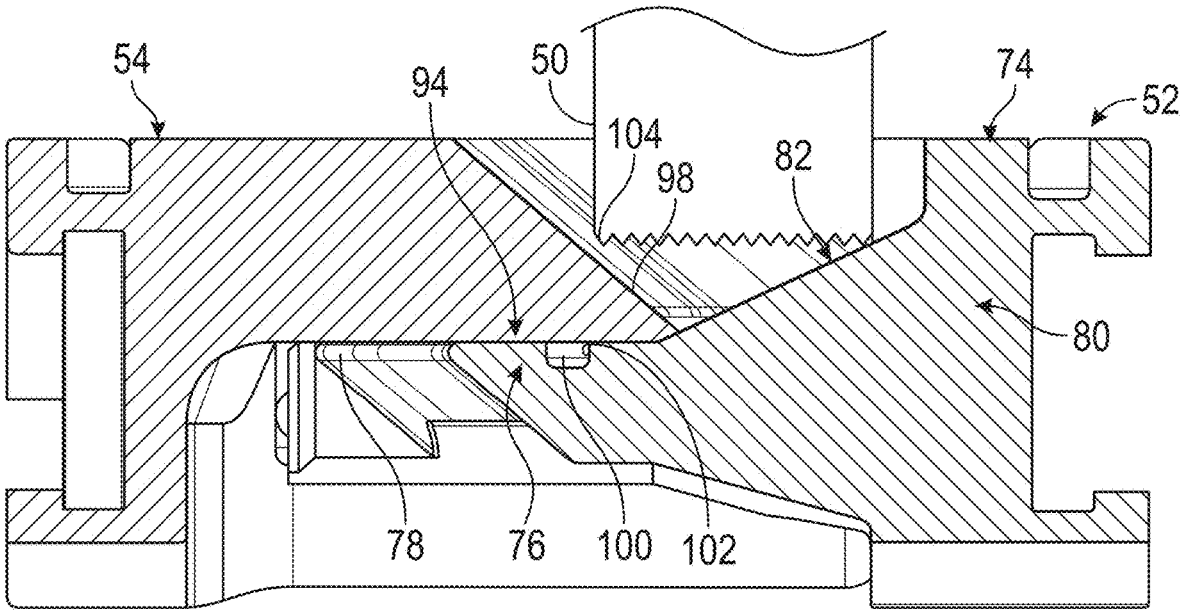
FIG. 5 is a cross-sectional illustration of an example of the shear ram illustrated in FIG. 4 being used with a corresponding shear ram to shear a tubular member, e.g. drill pipe, according to an embodiment of the disclosure.

With additional reference to FIG. 5, the ram 52 is illustrated as interacting with corresponding ram 54 so as to shear tubular member 50 during the shearing operation. In this example, the upper portion of tubular member 50 is illustrated as being lifted up and away from shearing region 94 via ramp 82 of ramp buttress 80. By lifting the cut tubular member 50 out of the space between ram 52 and corresponding ram 54, the rams 52, 54 are allowed to close without having to further deform the tubular member 50. Moving the upper portion of tubular member 50 out of this space reduces the force otherwise required while increasing the efficiency of the shearing operation. According to some embodiments, the corresponding ram 54 may have a cooperating sloped surface 98 to further facilitate lifting of the upper portion of tubular member 50.

In some embodiments, a seal 100 or a plurality of seals 100, e.g. an elastomeric seal, may be located between ram 52 and corresponding ram 54 so as to form a sealing engagement area during the shearing operation. In the example illustrated in FIGS. 4 and 5, seal 100 is located in a seal recess 102 formed across ram blade 76. The ramp buttress 80 and its ramp 82 are sized and positioned so as to lift the upper portion of tubular member 50 away from seal 100 before a back side or trailing portion 104 of tubular member 50 crosses the seal 100. This lifting action caused by ramp buttress 80 substantially protects the seal 100 against cuts, abrasion, or other damage from the cut end of tubular member 50.

Figure 6:
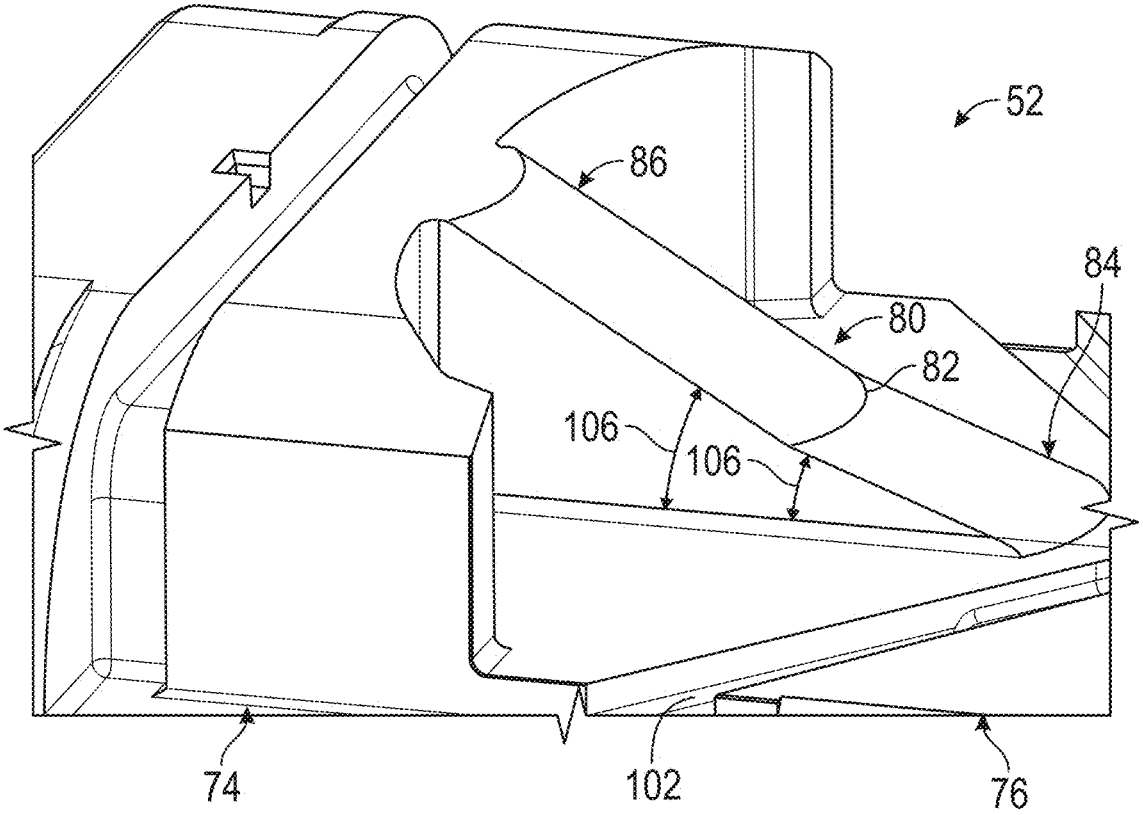
FIG. 6 is an orthogonal illustration of another example of a shear ram which may be used in the BOP shear ram assembly, according to an embodiment of the disclosure.

As set forth above, this lifting action may be achieved via one or more ramps 82 having various forms. As illustrated in FIG. 6, another embodiment of ram 52 comprises ramp 82 having differently angled surfaces established via a plurality of angled sections 106. In this example, two angled sections 106 are illustrated but greater numbers of angled sections 106 may be employed. By way of example, the angled sections 106 may comprise a first angled section of 20° or less, e.g. 5°-20°, which transitions to a second angled section of 30° or less, e.g. 22°-30°, moving in a direction from shearing edge 78 toward main body 74. In some applications, the changing angles of ramp 82 can further facilitate the lifting of tubular member 50 during a shearing operation.

Depending on the specific well operation, well environment, and well equipment, the overall well system 30 may be adjusted and various configurations may be employed. For example, the BOP system 32 may comprise many types of alternate and/or additional components. Additionally, the BOP system 32 may be combined with many other types of wellheads and other well components used in, for example, land-based or subsea hydrocarbon production operations. For example, one or more BOP shear ram assemblies 46 may be mounted into BOP stack 40 above well head 36 to facilitate a well drilling operation.

Furthermore, the components and arrangement of components in the BOP shear ram assembly 46 may vary according to the parameters of a given environment and/or well operation. For example, various types of actuator assemblies may be used to actuate the ram 52 and corresponding ram 54. Additionally, the size and materials of ram 52 and corresponding ram 54 may be adjusted according to the parameters of a given operation. Similarly, the size, configuration, angles, and other features of the ramp buttress 80 may be adjusted along with the number of ramps 82 for a given well application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a blowout preventer (BOP) stack having a BOP shear ram assembly constructed with opposing rams oriented to shear a tubular member, at least one of the opposing rams comprising:

a main body;

a blade extending from the main body, the blade comprising a shearing edge; and a ramp buttress secured to the blade to strengthen the blade, the ramp buttress having a ramp established by a thickness of the ramp buttress increasing from a thinner end to a thicker end in a direction moving away from the shearing edge toward the main body, wherein the ramp buttress is also secured to the main body, wherein the ramp buttress is positioned to lift the tubular member away from the shearing edge during a shearing operation, and wherein the at least one opposing ram comprises a seal positioned along the blade, the ramp buttress being located to lift the tubular member away from the seal before the entire tubular member crosses the seal during the shearing operation.

2. The system as recited in claim 1, wherein the ramp is formed with a flat surface.

3. The system as recited in claim 1, wherein the ramp buttress is secured by integrally forming the ramp buttress with the blade and the main body.

4. A system, comprising:

a blowout preventer (BOP) stack having a BOP shear ram assembly constructed with a first ram and a second ram, wherein the first ram and the second ram are opposing rams oriented to shear a tubular member, wherein the first ram comprises:

a main body;

a blade extending from the main body, the blade comprising a shearing edge; and a ramp buttress secured to the blade to strengthen the blade, the ramp buttress having a ramp established by a thickness of the ramp buttress increasing from a thinner end to a thicker end in a direction moving away from the shearing edge toward the main body, wherein the ramp buttress is positioned to lift the tubular member away from the shearing edge during a shearing operation, wherein the first ram comprises a seal positioned along the blade, the ramp buttress being located to lift the tubular member away from the seal before the entire tubular member crosses the seal during the shearing operation, and wherein the second ram comprises a sloped surface to further facilitate lifting the tubular member away from the shearing edge during the shearing operation.

5. The system as recited in claim 4, wherein the ramp is formed with a flat surface.

6. The system as recited in claim 4, wherein the ramp buttress also is secured to the main body.

7. The system as recited in claim 6, wherein the ramp buttress is secured by integrally forming the ramp buttress with the blade and the main body.

8. A method, comprising: providing a blowout preventer (BOP) shear ram assembly with a ram having a main body and a blade extending directly from the main body, wherein the blade comprises a shearing edge; securing a ramp buttress to the main body and to the blade to strengthen the blade; and locating a ramp on the ramp buttress so as to lift a tubular member away from a shear region the shearing edge during shearing of the tubular member, wherein the ramp comprises a linear incline.

9. The method as recited in claim 8, further comprising assembling the BOP shear ram assembly into a BOP stack; mounting the BOP stack above a wellhead; and utilizing the BOP stack in a drilling operation.

10. The method as recited in claim 8, wherein the securing step comprises integrally forming the ramp buttress with the blade and the main body.

* * * * *